US006375012B1

(12) United States Patent
Leyland et al.

(10) Patent No.: US 6,375,012 B1
(45) Date of Patent: Apr. 23, 2002

(54) SEGREGATOR BUCKET

(76) Inventors: Rodney James Leyland, Pontop Pike Farm, Dipton, Stanley, County Durham, DH9 9AS; Steven Hall, Pasture Farm, Usher Lane, Haxby, York, YO32 2LQ, both of (GB)

( * ) Notice: Subject to any disclaimer, the term of this patent is extended or adjusted under 35 U.S.C. 154(b) by 0 days.

(21) Appl. No.: 09/549,071

(22) Filed: Apr. 13, 2000

(30) Foreign Application Priority Data

Apr. 17, 1999 (GB) ..... 9908699

(51) Int. Cl.[7] ..... E02F 3/40

(52) U.S. Cl. ..... 209/421; 209/393; 209/419; 37/444; 37/901

(58) Field of Search ..... 209/419, 420, 209/421, 417, 385, 386, 389, 390, 393; 37/444, 901, 341; D15/25

(56) References Cited

U.S. PATENT DOCUMENTS 3,003,265 A * 10/1961 Lutjens ..... 37/444
3,765,490 A * 10/1973 Logue ..... 37/444
4,524,532 A 6/1985 Browning
5,172,498 A * 12/1992 Wack ..... 37/103
5,311,684 A * 5/1994 Van Dalfsen ..... 37/409
5,743,030 A 4/1998 Sirr

FOREIGN PATENT DOCUMENTS

| | | |
|---|---|---|
| DE | 42 35 098 | 4/1994 |
| EP | 0 106 412 | 4/1984 |
| GB | 0 284 643 | 10/1988 |
| WO | WO-90 12929 | * 11/1990 |
| WO | WO-91 18152 | * 11/1991 |

* cited by examiner

*Primary Examiner*—Donald P. Walsh
*Assistant Examiner*—Joseph C. Rodriguez
(74) *Attorney, Agent, or Firm*—Larson & Taylor, PLC

(57) ABSTRACT

A segregator bucket comprises an open-fronted shell including a pair of opposed sidewalls and a rear wall, the rear wall including a plurality of curved, transversely spaced primary ribs defining spaces therebetween, a cage member being mounted in the shell between the opposed sidewalls thereof and comprising a plurality of curved, transversely spaced secondary ribs defining spaces therebetween, the cage member being rotatable relative to the shell about an axis extending transversely of the shell between a loading position in which the secondary ribs are received within, substantially to close, the spaces between the primary ribs and a discharge position in which the secondary ribs are displaced from, to open, the spaces between the primary ribs.

19 Claims, 12 Drawing Sheets

'A' - 'A'

SEGREGATOR BUCKET

BACKGROUND OF THE INVENTION

This invention relates to segregator buckets for segregating materials of different particulate sizes, in particular material excavated by construction equipment such as excavators, backhoes, diggers, loaders and the like.

Excavated material contains particulates of varying sizes, ranging from small earth granules through to rubble and small rocks. Such excavated material is not readily reusable unless screened to give segregated materials of a more uniform size.

Various equipment is known for effecting such screening, but they all suffer from disadvantages. For example, it is known to provide so called shaker buckets provided with gaps therein for the passage therethrough of material within the bucket. However such buckets need to be shaken to effect the segregation, and this can impose considerable stress on the equipment, while the gaps in the buckets are at all times open whereby spillage on loading cannot be prevented.

An alternative bucket comprises a plurality of spaced, parallel ribs which are arranged to move to effect the segregation, but again the ribs are at all times spaced from one another whereby the bucket is always open, and have a tendency to clog in wet conditions EP 0284 643 discloses a rotary bucket the walls of which comprise a grid or mesh through which the material to be separated can pass. However, the mesh is open at all times, and has a tendency to clog in wet conditions, while the bucket is not of sufficiently robust construction to enable digging out of material to be processed and therefore requires the provision of a stock pile of material prior to processing.

WO 9118152 discloses a bucket incorporating transverse, rotatable, bladed shafts the blades of which overlap whereby, on synchronous rotation of the shafts, soil in the bucket is processed. However the bucket is not of a robust construction and cannot dig material out, thereby needing a stock pile of material prior to use, and being for loader applications rather than excavation applications. Further, there is a strong tendency for the bladed shafts to become clogged in wet conditions.

SUMMARY OF THE INVENTION

This invention is concerned with providing a segregator bucket which overcomes the aforementioned disadvantages of the prior art, and in particular which is of relatively robust construction to enable digging as well as segregating of material, which has a substantially closed position to prevent spillage of material on loading, and which is less prone to clogging in wet conditions than heretofore.

In accordance with the present invention there is provided a segregator bucket comprising an open-fronted shell including a pair of opposed sidewalls and a rear wall, said rear wall including a plurality of curved, transversely spaced primary ribs defining spaces therebetween, characterised by a cage member mounted in the shell between the opposed sidewalls thereof and comprising a plurality of curved, transversely spaced secondary ribs defining spaces therebetween, the cage member being rotatable relative to the shell about an axis extending transversely of the shell between a loading position in which the secondary ribs are received within, substantially to close, the spaces between the primary ribs and a discharge position in which the secondary ribs are displaced from, to open, the spaces between the primary ribs.

Thus it will be appreciated that, with the cage member in its loading position, the bucket can be charged with material to be segregated without spillage therefrom, the subsequent rotation of the cage member to open the spaces between the primary ribs not only enabling the material to be discharged through said spaces, but also serving to agitate and tumble the material within the shell whereby small particulates adhering to larger particulates are dislodged therefrom and thereafter fall between the primary ribs to be discharged from the bucket. Ultimately only larger particulates unable to pass through the spaces between the primary ribs will be retained in the bucket.

Preferably the radii of curvature of the outer surfaces of the primary and secondary ribs are substantially the same, while the circumferential extent of the secondary ribs is substantially equal to the circumferential extent of the spaces between the primary ribs, typically less than 180°.

It is further preferred that the widths of the secondary ribs is just less than that of the spaces between the primary ribs whereby there is a small clearance between the primary ribs and the secondary ribs in the loading position of the cage member.

The cage member may be rotatable through 360° within the shell in either direction, or may be arranged to oscillate therein between the loading and discharge positions to each side of the loading position.

DESCRIPTION OF THE PREFERRED EMBODIMENTS

Referring to FIGS. 1 to 6 the illustrated bucket, which is adapted for attachment to an excavator or like construction vehicle, comprises an open-fronted shell indicated generally at 2 and including a pair of opposed sidewalls 4,6 and a rear wall 8 defining a bucket volume within the shell 2.

Figure 5:
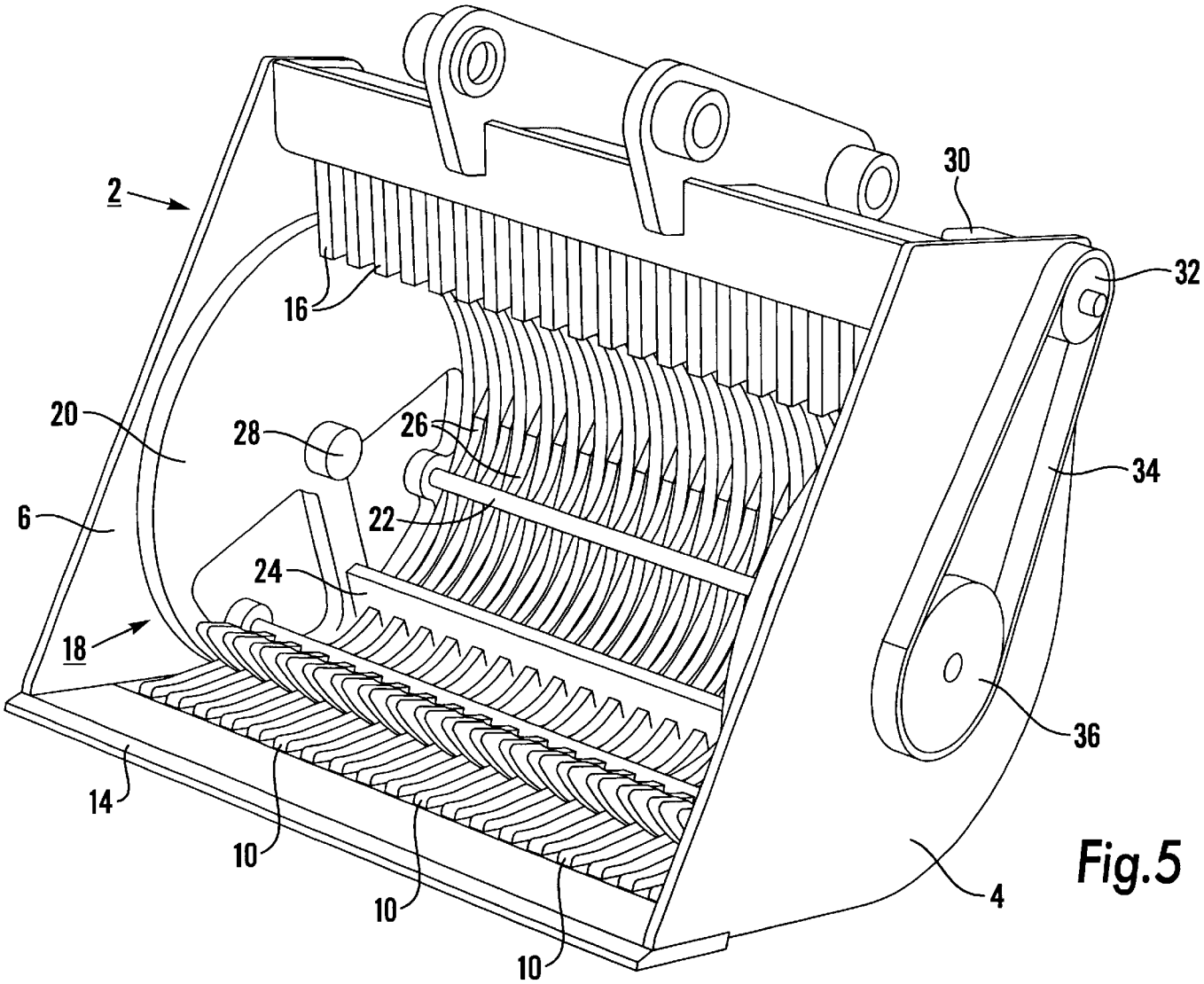
FIG. 5 is an isometric view of the bucket of FIG. 1 showing the interior of the bucket.
Figure 6:
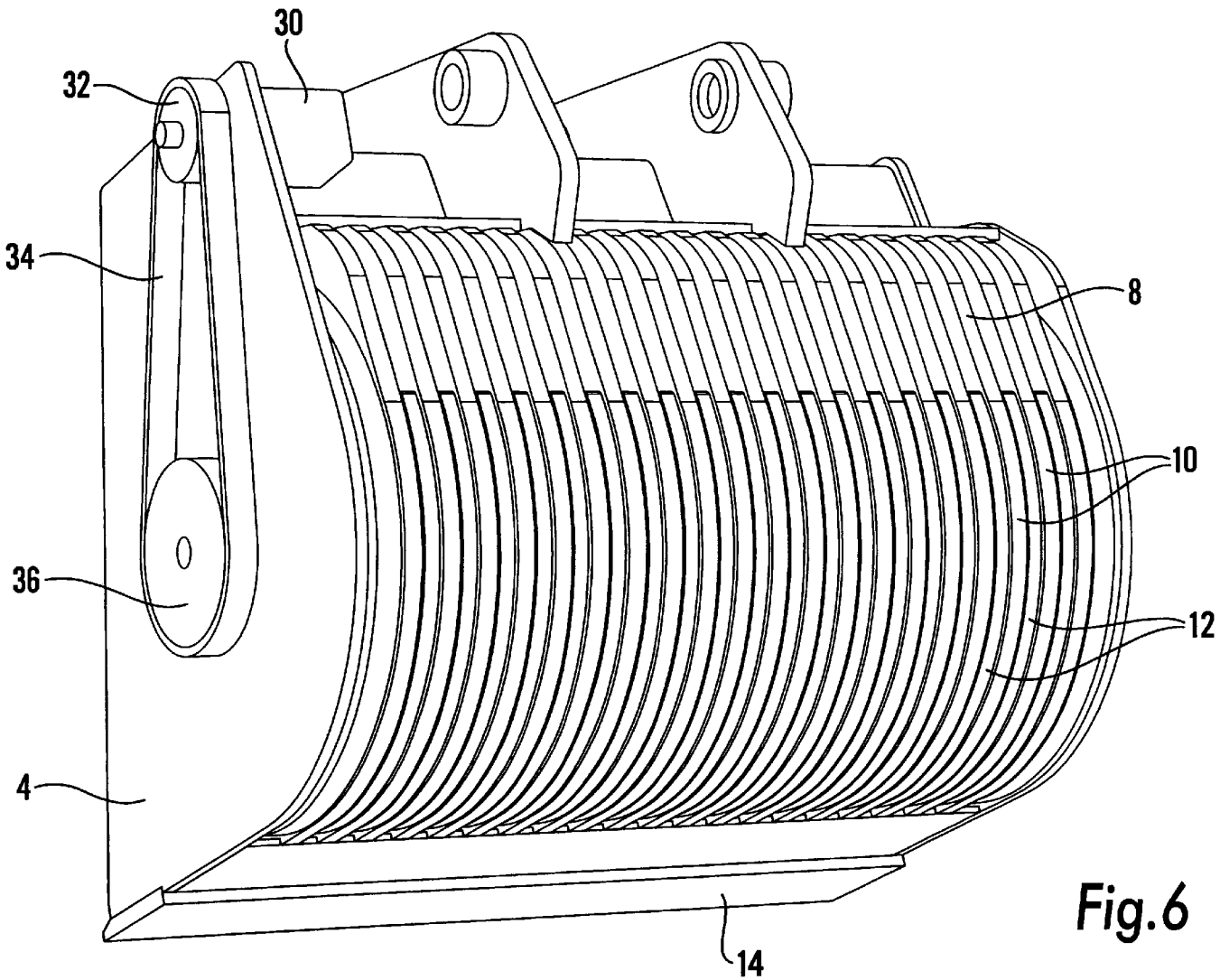
FIG. 6 is an isometric view of the bucket of FIG. 1 showing the rear of the bucket.

The rear wall 8 consists of a plurality of parallel curved ribs 10 extending from the lower edge to the upper edge of the open front of the shell 2 as best seen in FIG. 5. The ribs 10 are transversely spaced and define arcuate gaps 12 therebetween over an intermediate portion of their circumferential extent as best seen in FIG. 6 and as indicated by arc 'X' in FIG. 3. The spaces between adjacent ribs 10 above and below the gaps 12 are closed.

The lower ends of the ribs 10 taper into a transverse digging blade 14 extending along the lower front edge of the bucket, while the upper ends of the ribs 10, referenced 16, define a transverse comb extending the width of the bucket.

Figure 1:
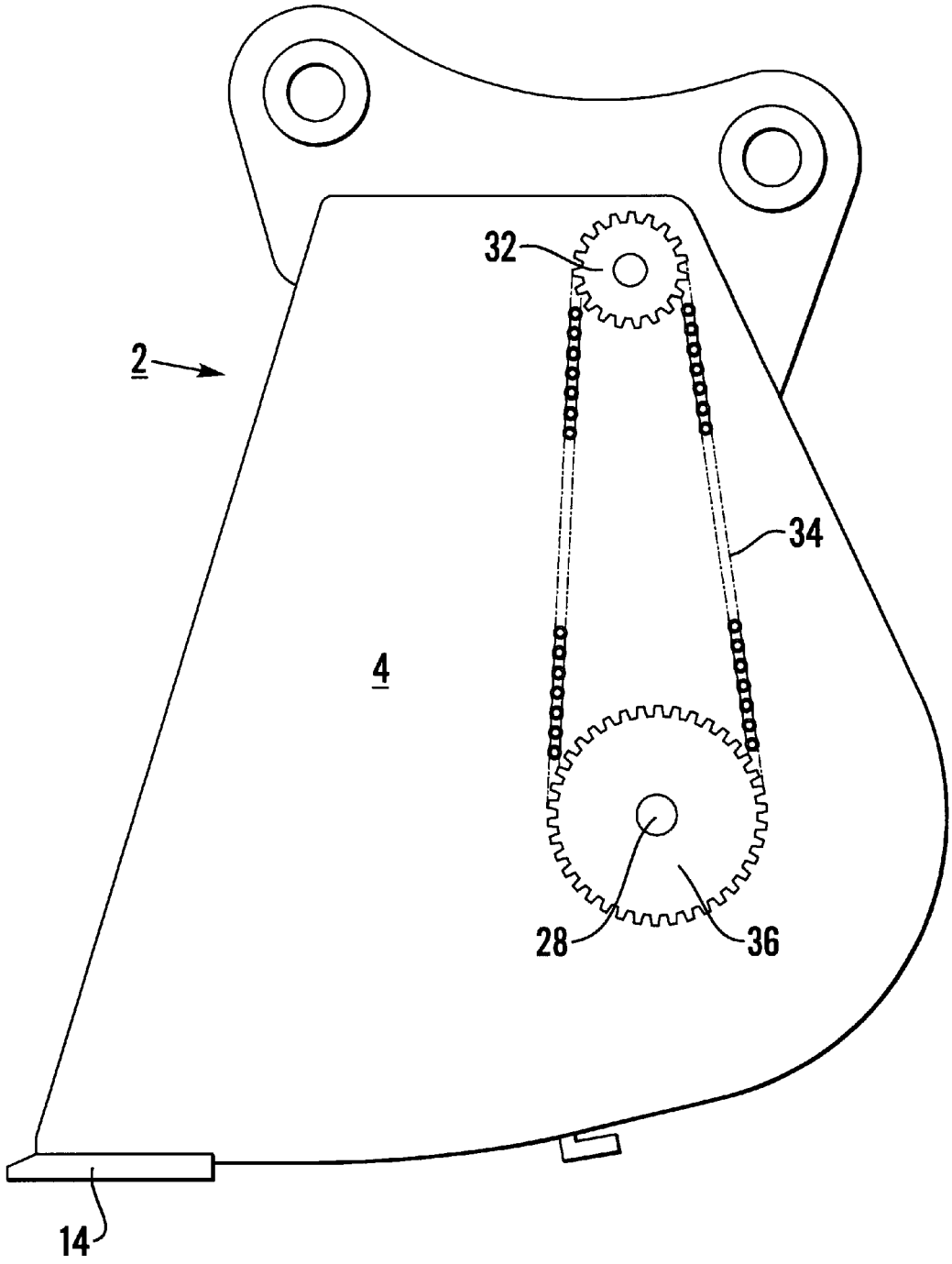
FIG. 1 is a side view of a first bucket according to the invention.
Figure 2:
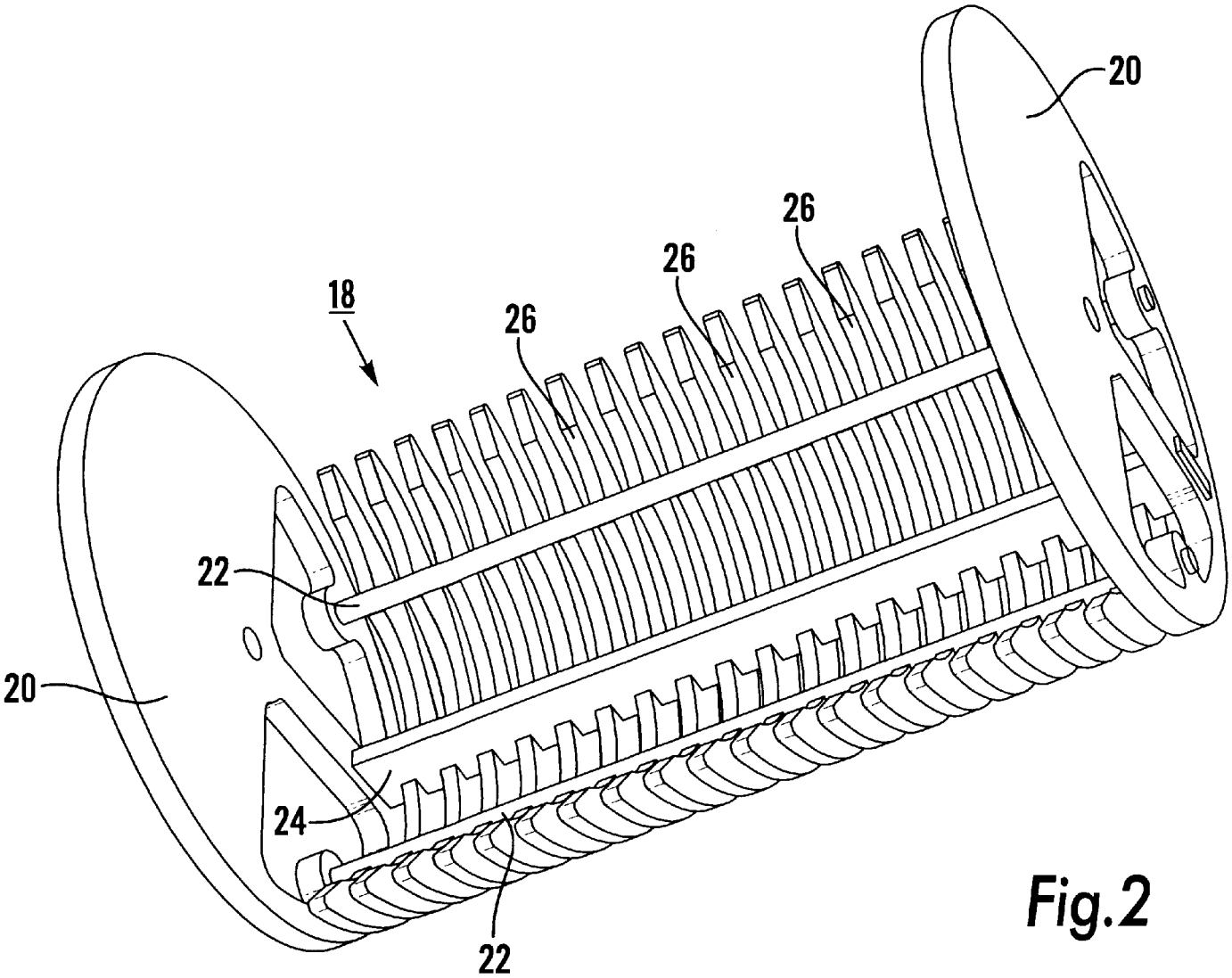
FIG. 2 is an isometric view of the cage member of the bucket of FIG. 1.

An inner cage, indicated generally at 18, is rotatably mounted in the shell 2. More particularly, the cage 18 comprises a pair of circular end plates 20 interconnected by a pair of transverse, circular section tie bars 22 and a transverse, rectangular section tie bar 24 as best seen in FIG. 2.

A plurality of parallel, curved ribs 26 are welded to the bars 22,24 at uniform spacings therealong the pitch of which corresponds with that of the gaps 12 in the shell 2, the thickness of the ribs 26 being just less than the width of the gaps 12.

Each end plate 20 of the cage 18 is provided with a stub axle 28 received within a corresponding aperture in an associated sidewall 4,6 of the shell 2, whereby the cage 18 is rotatably mounted in the shell 2.

The circumferential extent of the ribs 26 is substantially equal to that of the gaps 12 in the shell 2, while the outer radius of the ribs 26 is substantially equal to that of the ribs 10. Rotation of the cage 18 within the shell 2 is achieved by means of a motor 30 (FIGS. 5 and 6), a drive sprocket 32, a chain 34 and a driven sprocket 36 fixed to one of the stub axles 28, a chain guard and cover (not shown) normally enclosing the drive mechanism. Rotation may be clockwise, anticlockwise, over all or part of a complete revolution or oscillating as will be detailed below.

Part of the material of the end plates 20 on the sides thereof adjacent the ribs 26 is removed as clearly seen in FIG. 2 whereby the plates 20 become a counterweight to counteract the offset mass of the ribs 26 of the cage 18 during rotation.

Figure 3A:
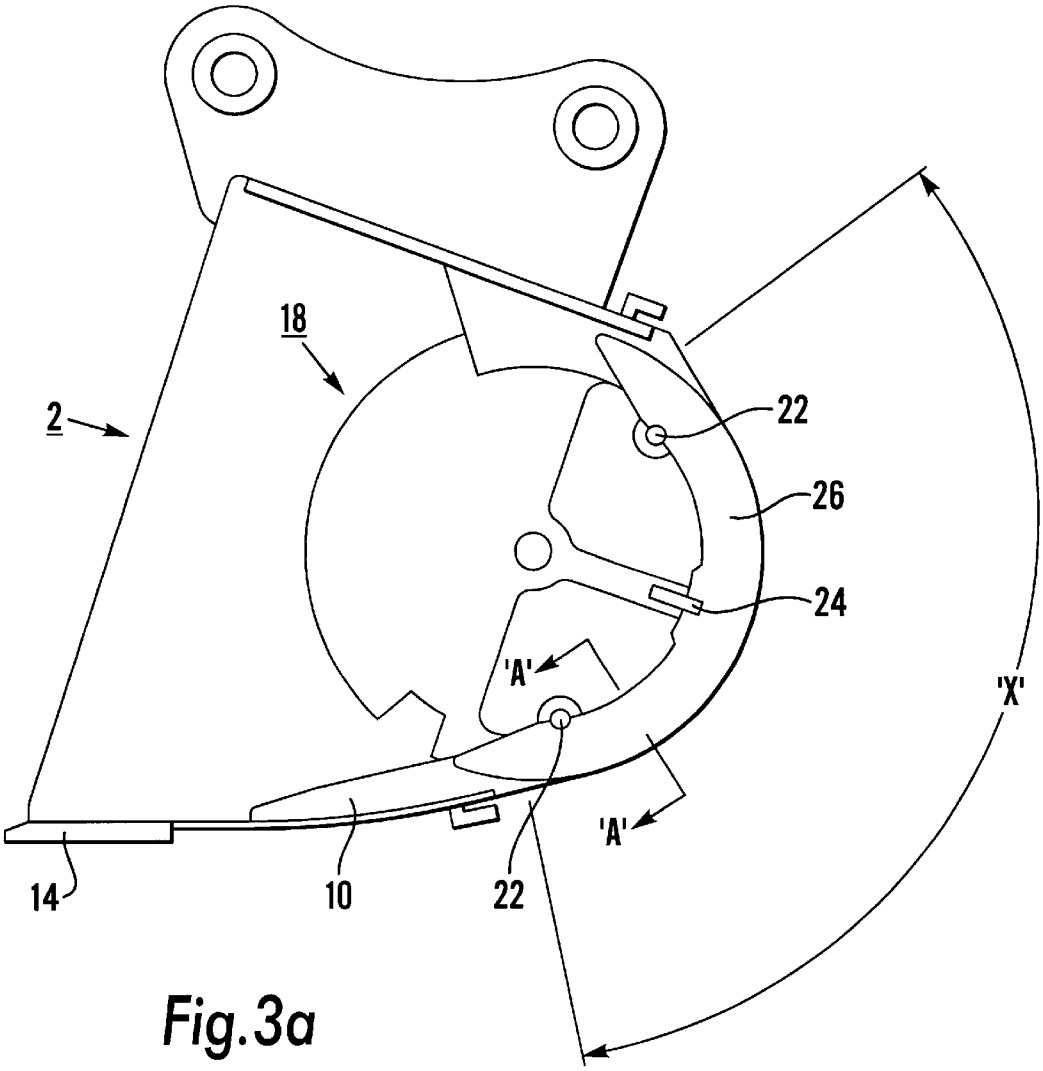
FIG. 3*a* is a section through the bucket of FIG. 1.
Figure 3B:
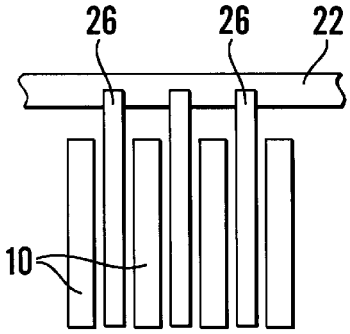
FIG. 3*b* is a section on the line A—A of FIG. 3*a;*
Figure 4C:
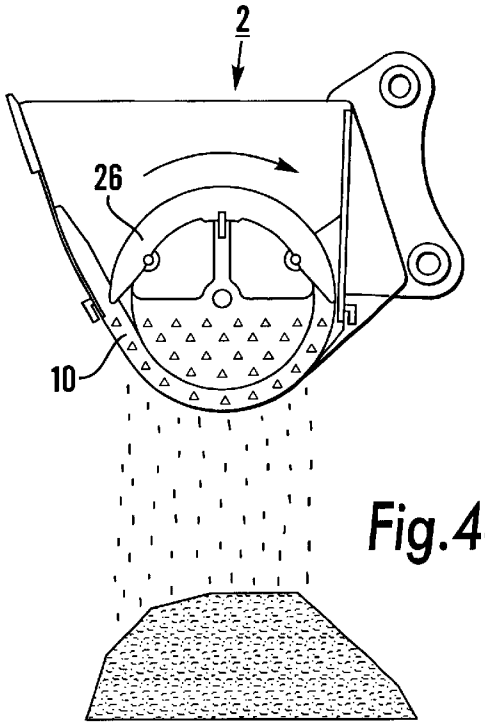
FIGS. 4*a, b* and *c* show the bucket of FIG. 1 during various stages of rotation of the cage member.
Figure 4B:
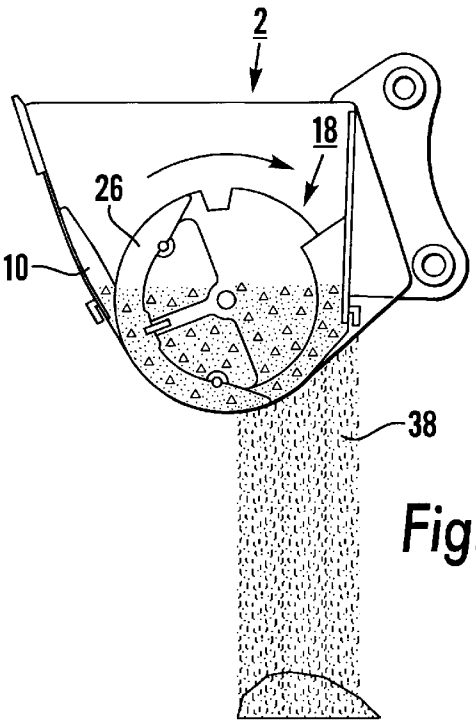
Figure 4A:
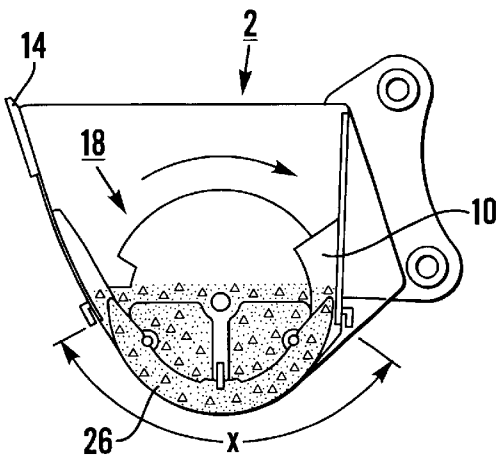

The described bucket has a loading position in which the cage 18 is rotatably located in the shell 2 with the ribs 26 thereof received within, substantially to close, the gaps 12 between the ribs 10 as in FIGS. 3 and 4*a*.

The bucket can thus be loaded with material to be segregated as shown in FIG. 4*a* without any undue spillage of the material from the bucket, the material being retained in the cage 18 for subsequent processing.

The cage 18 is then rotated as shown in FIGS. 4*b* and 4*c* to displace the ribs 26 from the gaps 12 whereby the gaps 12 are effectively opened. Particulate material the maximum dimensions of which are less than the width of the gaps 12 is then discharged from the bucket as a stream 38, the larger particulate remaining in the shell 2.

As well as opening the gaps 12, rotation of the cage 18 serves to agitate and tumble the material within the cage 18 and the shell 2 such that smaller particulates adhering to larger particulates are dislodged therefrom for subsequent discharge through the gaps 12.

The cage 18 may be rotated through 360° more than once, for example three or four times, in either direction to effect total segregation. Alternatively the cage 18 may be oscillated alternately to each side of the loading position for segregation purposes.

In all cases, the re-entry of the leading edges of the ribs 26 into the gaps 12 in the rear wall 8 prevents blockage or clogging of the gaps 12 that might otherwise occur, any material remaining in the gaps 12 or still in the bucket being carried forward by the front edges of the rotating ribs 26 and back into the body of the cage 18.

In particular, and as previously mentioned the upper ends of the ribs 10 of the shell 2 are extended beyond the tangential point of intersection with the ribs 26 of the cage 18 to a point that is radially struck from the common axis of the shell 2 and cage 26. The comb 16 so formed acts to prevent any larger particulates from being drawn into the wedge shaped section between the shell (2) and the outer edges of the cage 26. Without these combs there may be a tendency for the cage 26 to jam during rotation.

Such a comb 16 may also be incorporated at the lower ends of the ribs 10, particularly if the cage 18 is rotatable in both directions.

When the cage 18 has a full 360° of rotational freedom, the comb 16 is often only required on the ends of the ribs 10 facing the normal direction of rotation of the cage 18. The other ends of the ribs 10 can be left with a shallower profile which permits easier loading and discharging of the bucket and which does not retain compacted smaller particulates between the ribs 10.

Once segregation is complete, the larger particulates remaining in the shell 2/cage 18 can be dumped at a separate location.

Figure 7:
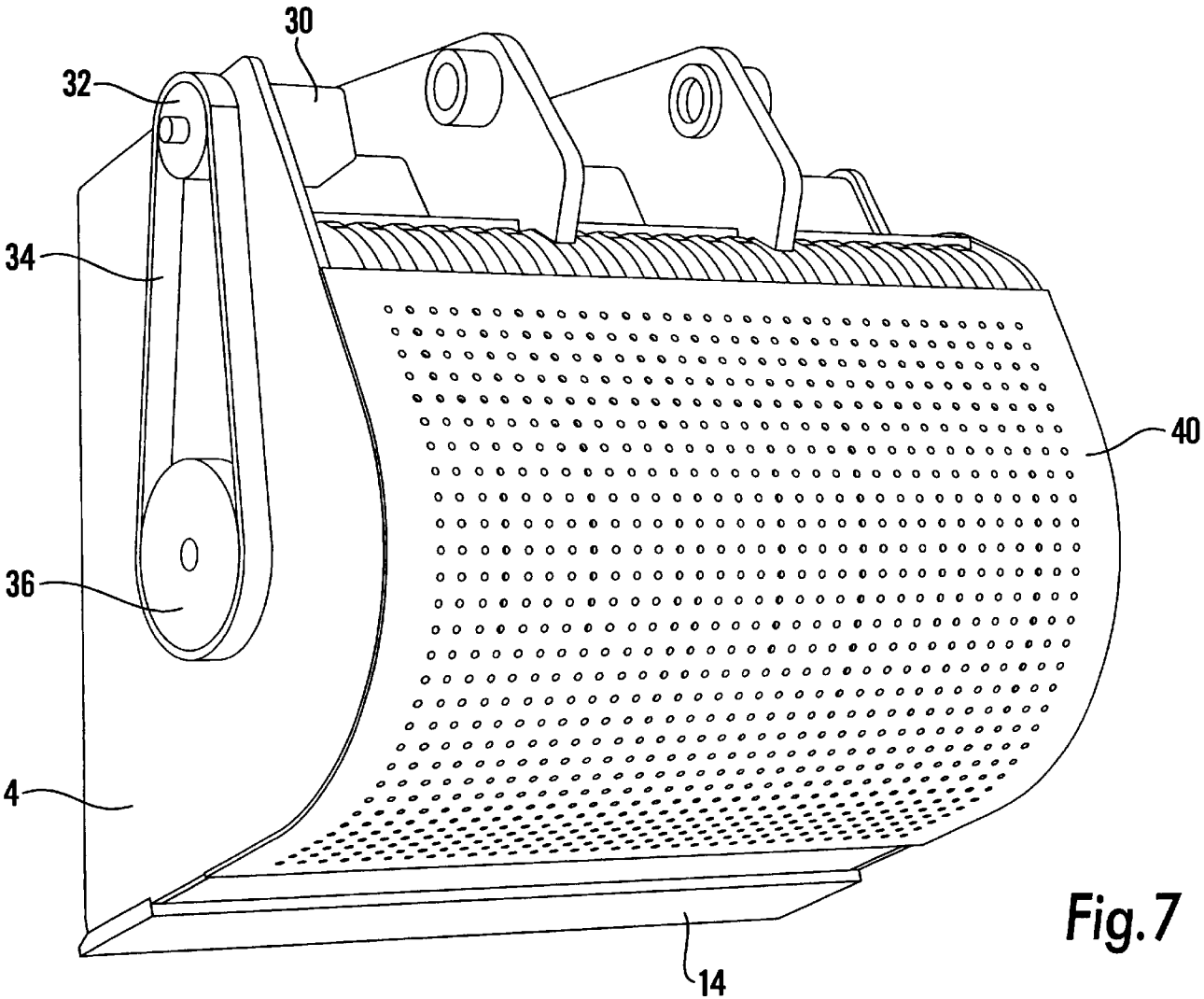
FIG. 7 is an isometric view of the bucket of FIG. 1 showing the rear of the bucket with an outer mesh screen fitted.

If it is desired to segregate only particles that are finer than those that would be normally be segregated by the gaps 12, an outer mesh screen 40 as shown in FIG. 7 could be secured externally of the curved rear wall 8 of the shell 2.

Figure 12:
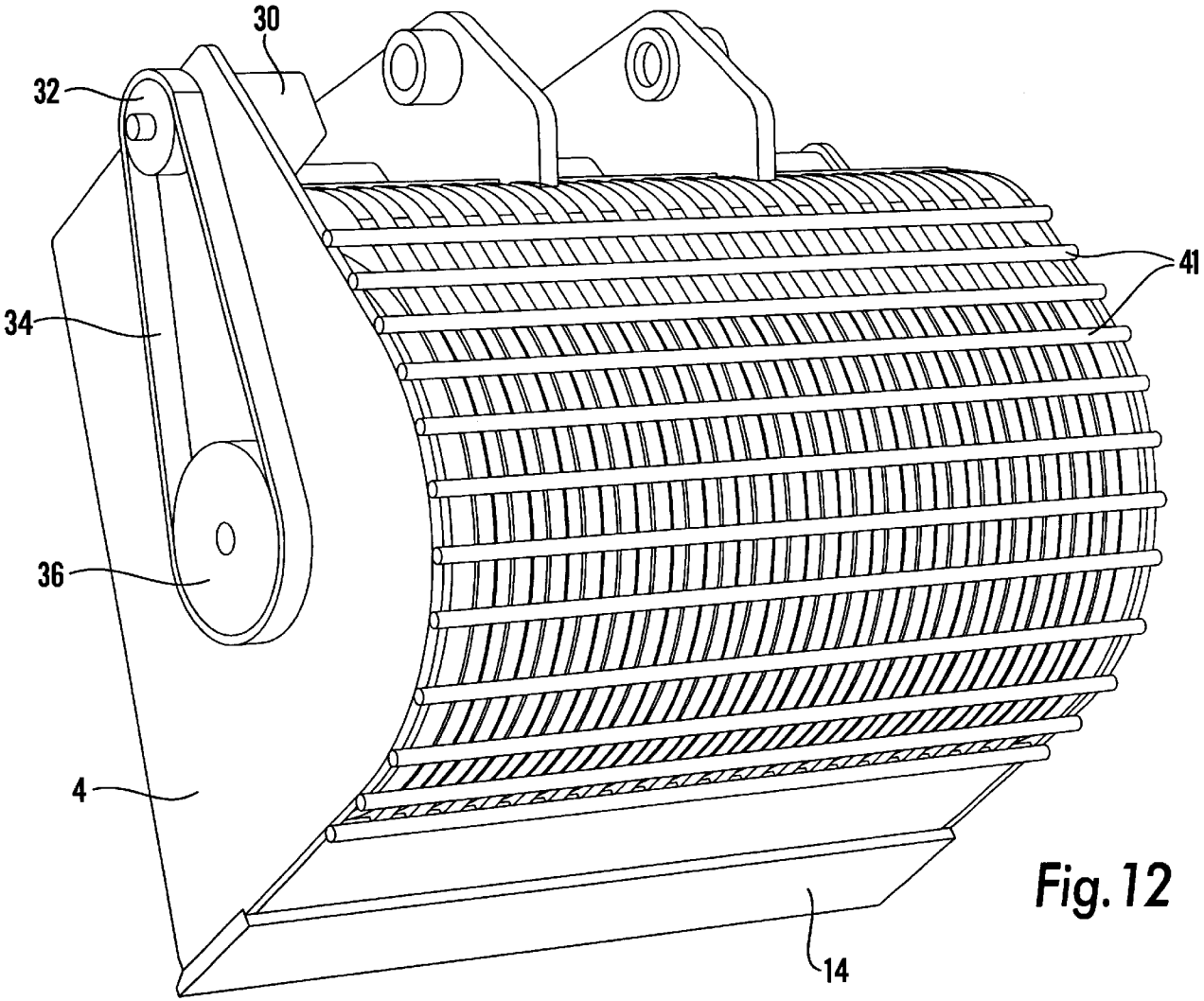
FIG. 12 is an isometric view of a third bucket according to the invention showing the rear of the bucket.

Alternatively, the bucket could include a series of parallel transverse bars 41 secured to the ribs 10 externally of the shell 2 as shown in FIG. 12 to provide, in combination with said ribs 10 and gaps 12, a mesh to the rear of the shell 2.

Figure 8A:
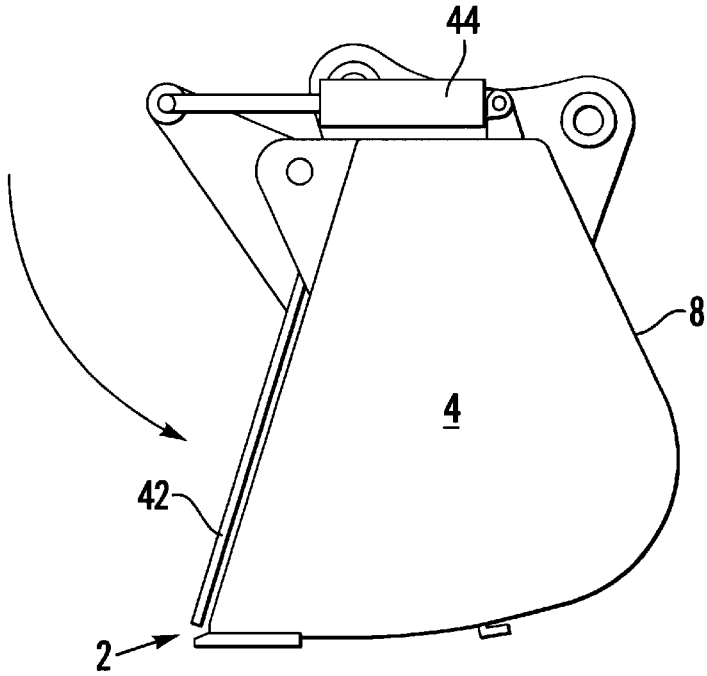
FIGS. 8*a* and 8*b* are side views of the bucket of FIG. 1 with a cover thereon in the closed and open positions respectively.
Figure 8B:
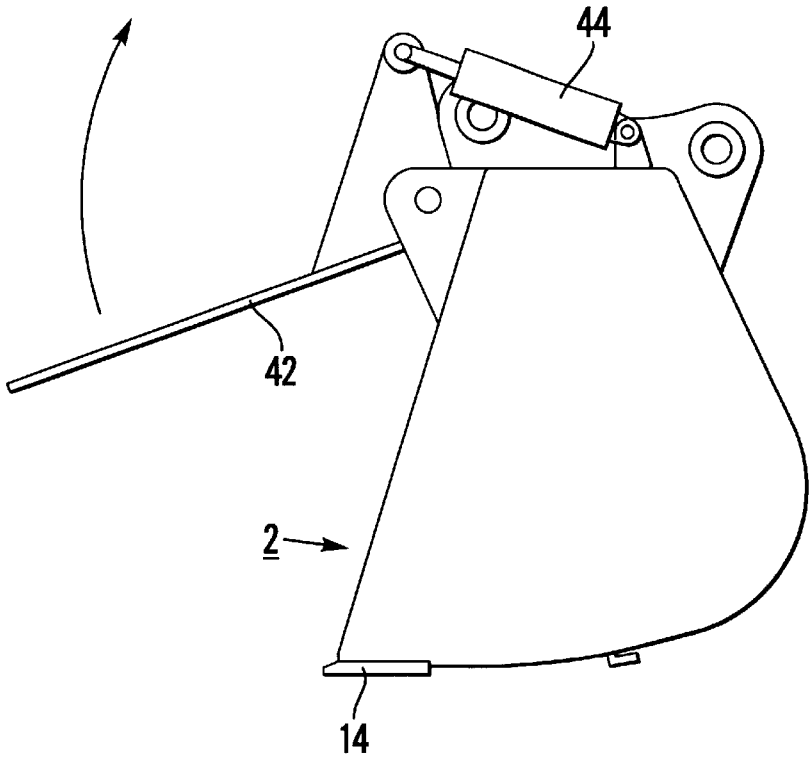

With some materials, it may be found that the rotation of the cage 18 causes the inadvertent and unintentional discharge of material from the open mouth of the shell 2 during the segregating process. This problem may be overcome by providing the shell 2 with a cover 42 movable between a closed position over the shell 2 as shown in FIG. 8*a*, and an open position providing access to the shell 2 as shown in FIG. 8*b*. In this embodiment, movement of the cover 42 between its open and closed positions is effected by means of a double-acting hydraulic ram 44.

Figure 9A:
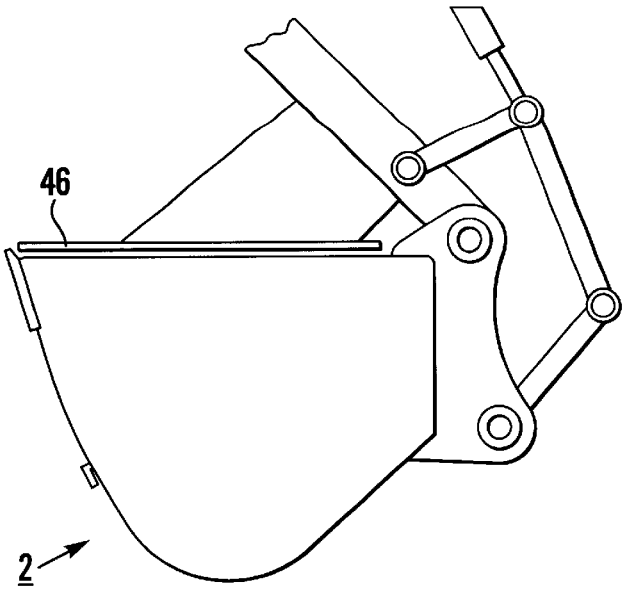
FIGS. 9*a* and 9*b* show a bucket with a fixed cover in the closed and open positions respectively.
Figure 9B:
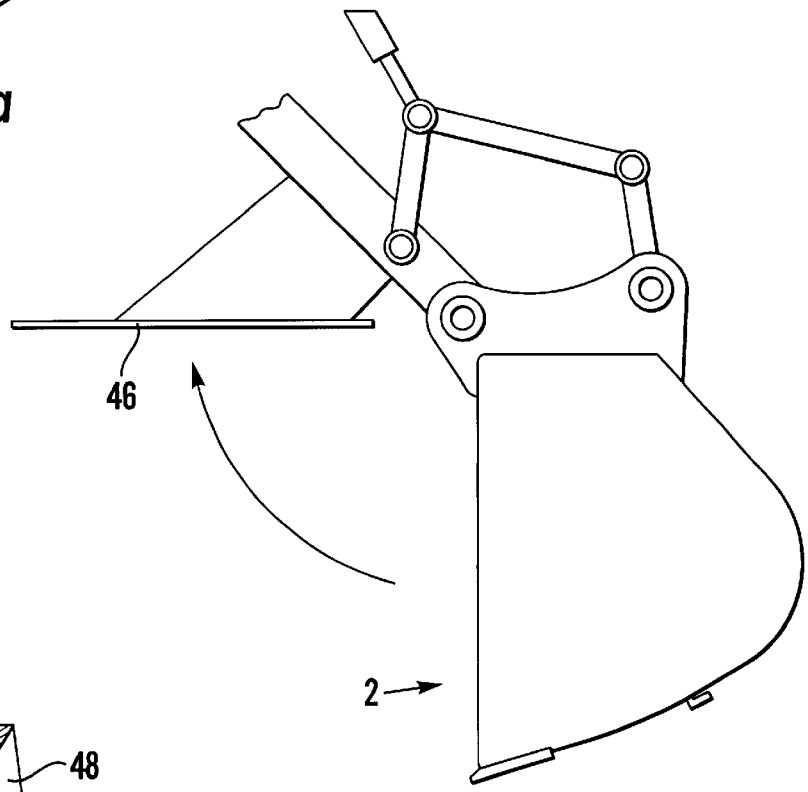
Figure 9C:
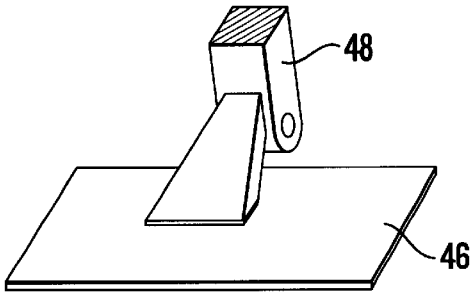
FIG. 9*c* is an isometric view of the cover of FIGS. 9*a* and 9*b;*

In an alternative embodiment of the invention shown in FIG. 9, a static cover 46 is provided which, with the bucket in its operative, segregating position as shown in FIG. 9*a*, abuts, to close, the shell 2, and which, with the bucket in its digging/dumping position shown in FIG. 9*b*, is displaced from, to open, the shell 2. FIG. 9*c* is a perspective view of the cover 46 attached to the arm 48 of an excavator.

Figure 10:
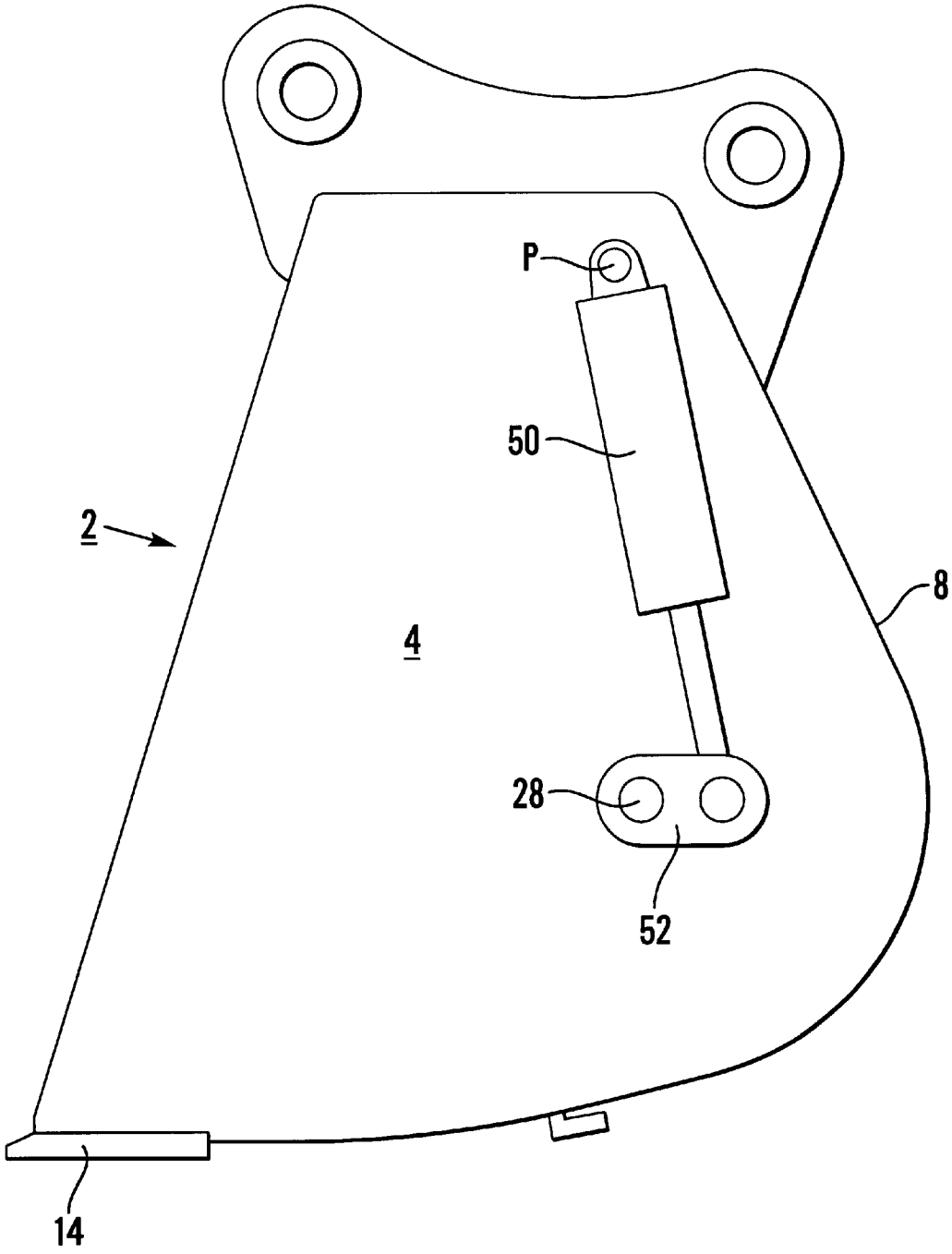
FIG. 10 is a side view of a second bucket according to the invention.

As previously mentioned, the cage 18 may be oscillated within the shell 2 rather than completely rotated therein, and FIGS. 10 and 11 illustrate such an arrangement. More particularly, one end of a double-acting hydraulic ram 50 is pivotally mounted at 'P' to one of the end plates 4 of the shell 2, the other end of the ram 50 being connected to a link arm 52 itself rigidly connected to the outer end of a stub axle 28 on the cage 18. Again a guard (not shown) would normally cover the ram 50 and arm 52.

Applying hydraulic pressure to the ram 50 in a first direction causes partial rotation of the cage 18 from the loading position in a clockwise direction as viewed in FIG.

Figure 11A:
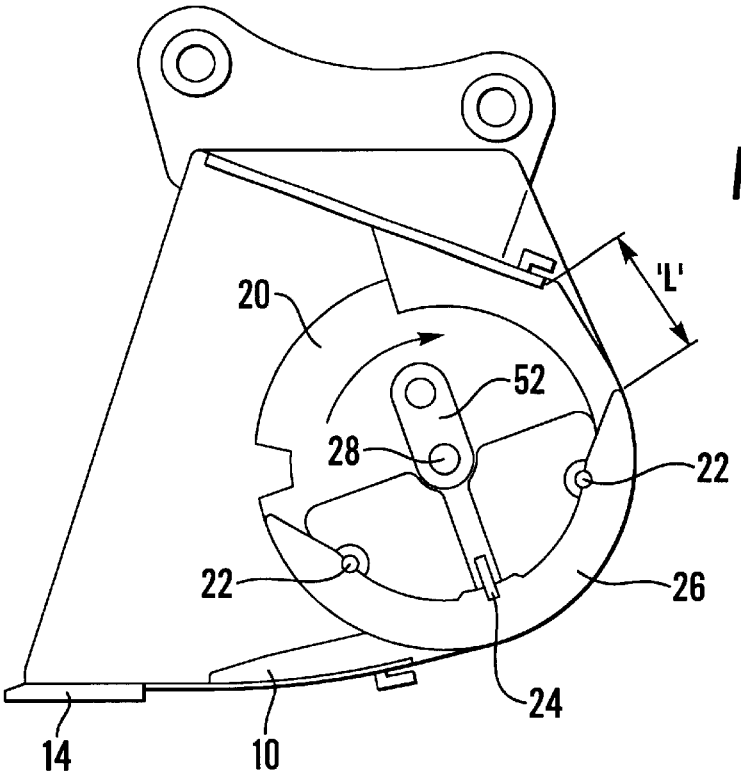
FIGS. 11*a* and 11*b* show the bucket of FIG. 10 in different stages of rotation of the cage member.
Figure 11B:
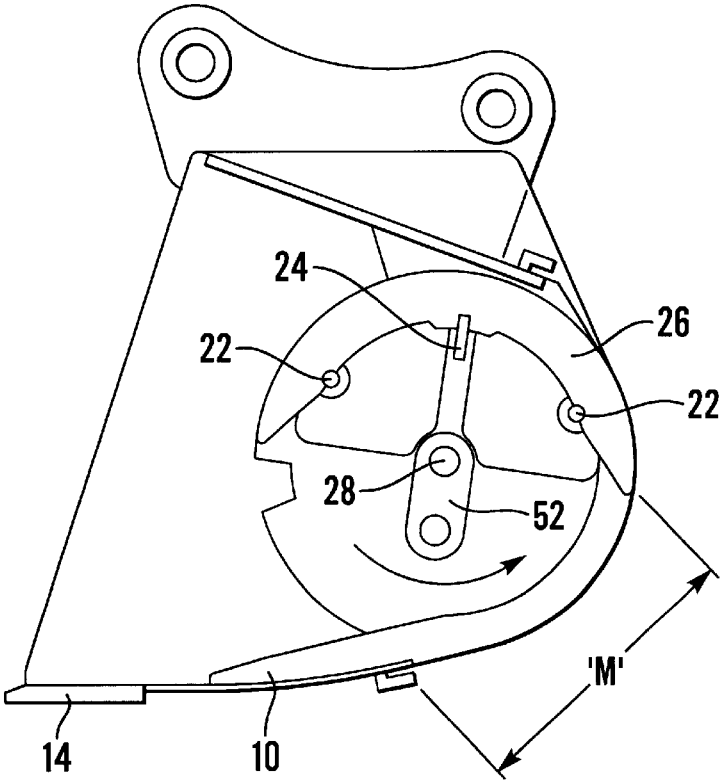

11*a* to expose the gaps 12 in the rear wall 8 of the shell 2 over an extent 'L' shown in FIG. 11*a*, subsequent application of hydraulic pressure to the ram 50 in the opposite direction resulting in anti-clockwise rotation of the cage 18 to close the extent 'L' and to expose the extent 'M' of the gaps 12 as shown in FIG. 11*b*.

Continuation of this process applies on oscillating motion to the cage 18 causing screening of material as detailed above.

Thus there is provided a segregator bucket in which excavated material is tumbled within a ribbed shell, the smaller particulates falling through gaps between the ribs of the shell, and the larger items, such as rubble and small rocks and stones being retained in the shell. The tumbling is effected by means of a rotatable cage which also intermittently opens and closes the gaps in the shell. The cage may be fully or partially rotated, primary screening being achieved by material falling under gravity through the gaps between the ribs of the bucket shell, the partial or full rotation of the cage imparting a tumbling action to the retained material which serves to dislodge small particulate from the larger particulates which, in turn, falls from the shell whereby, ultimately, only larger particulates which are unable to pass through the gaps between the ribs are retained within the bucket.

After the screening process, and subsequent to discharge of the larger particulates, the screened material can be re-handled as required by the same bucket with the cage in its loading or meshed position in the shell.

The drive to the cage may be any suitable means such as sprocket and chain, gear train, worm and gear, belt, rack and pinion, hydraulic ram, linear actuator or any combination of these.

The ability to contra-rotate the cage provides a means of releasing the cage if it becomes jammed during the screening process.

The bucket would normally be constructed from metal such as mild steels and wear resistant alloy steels.

The mounting of the cage in the shell by stub axles offers the maximum unimpeded opening to materials being loaded into the bucket. However, shaft mounting of the cage to the shell is possible.

The bucket can be designed for mounting on excavators or loaders, and can be designed for use in static applications in conjunction with an appropriate method of loading.

The bucket of the invention can dig and load as well as segregate, and can do so at the point of excavation with equipment already available on site.

Thus the bucket is multi-functional, is extremely robust, has a self-cleaning action which minimizes the risk of clogging allowing use in wet conditions, is simple in operation, working from standard hydraulic circuits on the associated excavator or loader, and has a high productivity rate along with efficient and effective screening.

What we claim and desire to secure by Letters Patent is:

1. A segregator bucket comprising an open-fronted shell including a pair of opposed sidewalls and a rear wall, the rear wall including a plurality of curved, transversely spaced primary ribs defining spaces therebetween, and a cage member mounted in the shell between the opposed sidewalls thereof and comprising a plurality of curved, transversely spaced secondary ribs defining spaces therebetween, the cage member being rotatable relative to the shell about an axis extending transversely of the shell between a loading position in which the secondary ribs are received within the spaces between the primary ribs substantially to fill said spaces whereby the bucket can be loaded with material to be segregated, and a screening position in which the secondary ribs are displaced from the spaces between the primary ribs to open said spaces whereby screened material can pass through said spaces.

2. A bucket as claimed in claim 1 in which the radii of curvature of the outer surfaces of the primary ribs and the secondary ribs are substantially the same.

3. A bucket as claimed in claim 2 in which the circumferential extent of the secondary ribs is substantially equal to the circumferential extent of the spaces between the primary ribs.

4. A bucket as claimed in claim 1 in which the width of the secondary ribs is just less than that of the spaces between the primary ribs whereby there is a small clearance between the primary ribs and the secondary ribs in the loading position of the cage member.

5. A bucket as claimed in claim 1 in which the cage member is rotatable through 360° within the shell in either direction.

6. A bucket as claimed in claim 1 in which the cage member can oscillate within the shell to each side of the loading position.

7. A bucket as claimed in claim 1 and including a cover member for location over the front of the shell.

8. A bucket as claimed in claim 7 in which the cover member is movable between a closed position over the front of the shell and an open position displaced from the shell.

9. A bucket as claimed in claim 1 and including a mesh screen secured to the shell externally of the rear wall thereof.

10. The segregator bucket of claim 1 wherein the shell and the cage are arranged such that, subsequent to loading of the bucket with material to be segregated, and on movement of the cage member between the loading and screening positions, the cage member can agitate the material to be screened within the shell, and passage of the secondary ribs between the primary ribs, can displace material from the spaces between the primary ribs.

11. A segregator bucket comprising an open-fronted shell including a pair of opposed sidewalls and a rear wall, the rear wall including a plurality of curved, transversely spaced primary ribs defining spaces therebetween, and a cage member mounted in the shell between the opposed sidewalls thereof and comprising a plurality of curved, transversely spaced secondary ribs defining spaces therebetween, the cage member being rotatable relative to the shell about an axis extending transversely of the shell between a loading position in which the secondary ribs are received within the spaces between the primary ribs substantially to fill said spaces whereby the bucket can be loaded with material to be segregated, and a screening position in which the secondary ribs are displaced from the spaces between the primary ribs to open said spaces whereby screened material can pass through said spaces, the shell and the cage arranged such that, subsequent to loading of the bucket with material to be segregated, and on movement of the cage member between the loading and screening positions, the cage member can agitate the material to be screened within the shell and the secondary ribs, on the passage of the secondary ribs between the primary ribs, can displace material from the spaces between the primary ribs.

12. The segregator bucket as claimed in claim 11 in which the radii of curvature of the outer surfaces of the primary ribs and the secondary ribs are substantially the same.

13. The segregator bucket as claimed in claim 12 in which the circumferential extent of the secondary ribs is substantially equal to the circumferential extent of the spaces between the primary ribs.

14. The segregator bucket as claimed in claim 11 in which the width of the secondary ribs is just less than that of the spaces between the primary ribs whereby there is a small clearance between the primary ribs and the secondary ribs in the loading position of the cage member.

15. The segregator bucket as claimed in claim 11 in which the cage member is rotatable through 360° within the shell in either direction.

16. The segregator bucket as claimed in claim 11 in which the cage member can oscillate within the shell to each side of the loading position.

17. The segregator bucket as claimed in claim 11 and including a cover member for location over the front of the shell.

18. The segregator bucket as claimed in claim 17 in which the cover member is movable between a closed position over the front of the shell and an open position displaced from the shell.

19. The segregator bucket as claimed in claim 11 and including a mesh screen secured to the shell externally of the rear wall thereof.

* * * * *